US005246044A

United States Patent [19]

Robertson et al.

[11] Patent Number: 5,246,044

[45] Date of Patent: Sep. 21, 1993

[54] FUEL DISPENSER PUMP CONTAINMENT APPARATUS

[75] Inventors: Stephen E. Robertson, Woodbury, N.J.; Frank C. Marchica, East Meadow, N.Y.

[73] Assignee: Environmental Protection Products, Inc., East Meadow, N.Y.

[21] Appl. No.: 951,040

[22] Filed: Sep. 24, 1992

Related U.S. Application Data

[63] Continuation of Ser. No. 658,174, Feb. 20, 1991, abandoned.

[51] Int. Cl.[5] ..... H65B 1/04

[52] U.S. Cl. ..... 141/86; 141/88; 141/311 A; 137/312; 222/108; 220/571; 404/25

[58] Field of Search ..... 141/86, 88, 311 A; 220/571, 573; 137/312, 367, 313; 405/52; 222/108; 404/25, 26; 52/19-21

[56] References Cited

U.S. PATENT DOCUMENTS

| | | | |
|---|---|---|---|
| 4,201,307 | 5/1980 | Malloy | 220/573 X |
| 4,651,887 | 3/1987 | Patrick | 220/571 |
| 4,921,115 | 5/1990 | Fields, III | 141/86 X |
| 4,930,602 | 6/1990 | Gust | 220/573 |
| 4,960,346 | 10/1990 | Tamayo | 141/86 X |
| 4,988,020 | 1/1991 | Webb | 222/108 |
| 4,989,634 | 2/1991 | Rieseck | 137/363 |
| 5,058,774 | 10/1991 | Hartman et al. | 222/108 X |
| 5,099,894 | 3/1992 | Mozeley, Jr. | 141/86 |

FOREIGN PATENT DOCUMENTS

| | | | |
|---|---|---|---|
| 1233677 | 2/1967 | Fed. Rep. of Germany | 220/571 |

*Primary Examiner*—Ernest G. Cusick

*Attorney, Agent, or Firm*—Anthony J. Casella; Gerald E. Hespos

[57] ABSTRACT

This invention provides an apparatus for containing and terminating fuel leaks at a dispenser pump island. The dispenser containment system of the subject invention comprises a substantially rectangular fiberglass box-like structure, having a lower trough portion and an upper hood portion. The lower trough portion of the dispenser containment system is provided with a plurality of integral fiberglass couplings for interconnecting containment hose with the dispenser pump, an integral fiberglass conduit entry penetration for enabling conductive wires to extend through the dispenser containment system and into the fuel dispenser pump and an integral fiberglass vapor recovery port for removing stage II vapor from the dispenser pump.

8 Claims, 3 Drawing Sheets

FUEL DISPENSER PUMP CONTAINMENT APPARATUS

CROSS REFERENCE TO RELATED APPLICATION

This application is a continuation of application Ser. No. 658,174, filed Feb. 20, 1991, now abandoned.

BACKGROUND OF THE INVENTION

Gasoline dispenser pumps which are operable to draw fuel from underground petroleum storage tanks have been subjected to high standards with respect to leak management set by applicable statutes in many states.

Fuel leakage causes many problems. The escaped fuel becomes a dangerous fire hazard which could threaten adjacent buildings or cause a fire in an underground sewage line or in other areas. Loss of fuel is wasteful and causes an economical burden to the owner of the dispenser pump and the loss of a non-renewable energy source. Fuel leakage may even cause ground water to be contaminated. The contamination of ground water by various hydrocarbon pollutants has become a serious problem in recent years. Therefore, environmental standards in many states today require service stations to employ leak detection and containment systems at the dispenser pump island in order to prevent the contamination of ground water.

Prior art fuel pump dispenser containment boxes have been employed in service stations. One such containment apparatus is constructed of heavy 12 gage steel with an epoxy coating. The steel containment apparatus is provided with an automatic shutdown system comprising a float reservoir which mechanically closes an impact valve the instant a leak is detected. The steel containment system is further provided with hardware accessories for on site installation. It is however, undesirable to install a structure fabricated of metal in a subterranean environment over an extended period of time because it is likely to corrode.

Another apparatus is a fiberglass pan insert which may be removably attached to a metal leak catchment pump box to permit access to piping. The pan insert is not provided with pre-located apertures for receiving piping. Therefore, the installation of the pan insert requires unreliable hole drilling and the employment of uniseal fittings, grommets and caulking materials at the work site.

Still another apparatus is a blow molded polyethylene containment box having a steel frame. The polyethylene containment box is not provided with pre-located apertures for receiving piping. Therefore, couplings must be installed at the work site, thereby requiring unreliable hole drilling and costly installation of grommets and bulkhead fittings to ensure the integrity of the system.

Therefore, it is an object of the subject invention to provide an apparatus for containing fuel leaks from a fuel dispenser pump constructed of a non-corrosive fiberglass material.

It is a further object of the subject invention to provide an apparatus for containing fuel leaks from a fuel dispenser pump which requires no on site drilling procedures or grommet installation.

It is a further object of the subject invention to provide an apparatus for containing fuel leaks from a dispenser pump having pre-located integral fiberglass couplings which decrease installation time.

It is a further object of the subject invention to provide an apparatus for containing fuel leaks from a dispenser pump having pre-located integral fiberglass couplings which decrease installation costs.

It is a further object of the subject invention to provide an apparatus for containing fuel leaks from a fuel dispenser pump having integral fiberglass couplings which are compatible with all major brands of piping.

It is a further object of the subject invention to provide an apparatus for containing fuel leaks from a dispenser pump having at least one pre-located integral fiberglass conduit entry penetrations to permit conductive wires to extend through the apparatus.

SUMMARY OF THE INVENTION

The fuel dispenser pump containment system of the subject invention is especially adapted for quick and easy installation at the dispenser pump island, and is fabricated from non-corrosive fiberglass that is suitable for subterranean service over extended periods of time. It is provided with a plurality of integral fiberglass couplings and integral conduit entry penetration which are pre-located in the factory. Therefore, there is no time wasted on unreliable drilling and grommet installation at the work site. Furthermore, bulkhead fittings are not required as in prior art containment systems.

The fuel dispenser pump containment system of the subject invention basically comprises a substantially rectangular box-like structure having an upper hood portion and a lower trough portion. The upper hood portion of the dispenser containment system is provided with stud bolts for installing the system beneath the fuel dispenser pump. The upper hood portion is further provided with support members to rigidly connect shear valve assemblies to the dispenser pump containment system.

The lower trough portion of the dispenser containment system of the subject invention has an angularly-pitched bottom wall. A plurality of spaced apart integral fiberglass couplings extend through and beyond the bottom wall, and are provided to interconnect the product hose with the fuel dispenser pump. Further, an integral fiberglass conduit entry penetration extends through and beyond the bottom wall of the lower trough portion such that conductive cables may extend through the dispenser containment system and into the fuel dispenser pump. Furthermore, an integral fiberglass vapor recovery port extends through and beyond the bottom wall of the trough portion such that Stage II vapor from the dispenser pump may be removed therefrom.

The dispenser containment system of the subject invention and all of the components therein are compatible with gasoline, gasohol, ethanol, jet fuel, av gas, kerosene, diesel fuel and motor oil.

DETAILED DESCRIPTION OF THE PREFERRED EMBODIMENT

Figure 1:
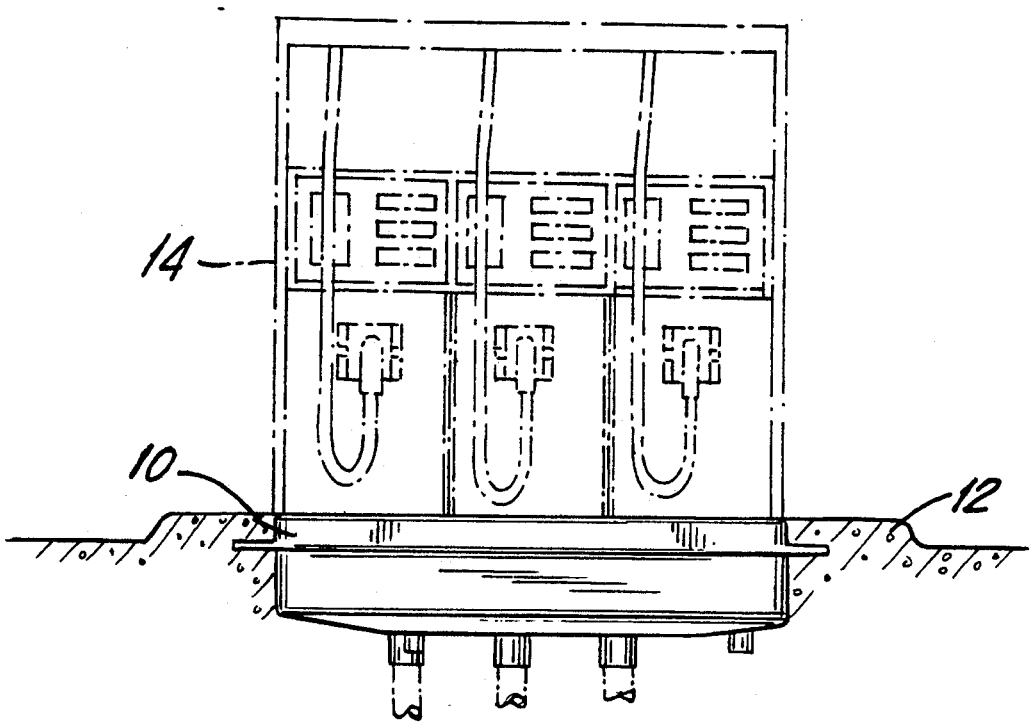
FIG. 1 is an elevational view of the dispenser containment apparatus of the subject invention installed beneath a fuel dispenser pump island.

A preferred embodiment of the fuel dispenser pump containment apparatus of the subject invention is illustrated in FIGS. 1 through 5, and is designated generally by reference numeral 10. Referring to FIG. 1, the dispenser containment system 10 is intended to be employed beneath an island 12 having a fuel dispenser pump 14, in order to terminate and contain fuel leakage from the dispenser 14. The dispenser containment system 10 basically comprises a substantially rectangular fiberglass box-like structure, having a lower trough portion 20 and an upper hood portion 22.

Turning to FIGS. 2 through 5, the lower trough portion 20 of the containment system 10 includes opposed side walls 24 and 26, and a pitched bottom wall 28 having a downward angular pitch "$\alpha$". The upper hood portion 22 of the containment system 10 includes opposed side edges 30 and 32 and opposed front and rear edges 34 and 36.

The upper hood portion 22 is provided with an up-turned lip 38 which extends perpendicularly therefrom in order to prevent water from entering the containment system 10. Opposed flanges 40 and 42 extend outwardly from the opposed side edges 30 and 32, respectively, each having a pair of spaced apart bolt holes 44 for mounting the containment system 10 to steel cross members of a steel island form (not shown) and subsequently encased in the concrete island 12. The hood portion 22 further includes a plurality of upwardly extending installation bolts 46 disposed in spaced apart relationship intermediate opposed front edge 34 and up-turned lip 38 and intermediate rear edge 36 and up-turned lip 38, for mounting the containment system 10 to the fuel pump dispenser 14.

The lower trough portion 20 of the dispenser containment system 10 includes first, second and third spaced apart integral fiberglass couplings 48, 50 and 52 which extend through the bottom wall 28 thereof on the longitudinal axis of the substantially rectangular containment system 10 such that each of the couplings 48, 50 and 52 are disposed above and below the bottom wall 28. First integral coupling 48 is disposed adjacent side wall 24, third integral coupling 52 is disposed adjacent side wall 26 and second integral coupling 50 is disposed intermediate first and third integral couplings 48 and 52. Each of the couplings 48, 50 and 52 is provided with an internal threaded portion 54 for engagement with the threaded portion 56 of a product containment hose 58. The connection of a product containment hose 58 with each of the couplings 48, 50 and 52 preferably incorporates a threaded and bonded joining system which involves the application of a standard epoxy adhesive at the time of assembly such that fast positive makeup, and "backout" prevention are assured.

The upper portion 60 of each of the integral couplings 48, 50 and 52 are connectable with a standard 4" by 3" rubber reducing bushing 62, which is secured to each of the integral couplings 48, 50 and 52 by a first stainless steel clamp 64. The rubber reducing bushing 62 is further connected to a conventional shear valve assembly 66 of the fuel dispenser pump 14 by a second stainless steel clamp 68.

The lower trough portion 20 of the dispenser containment system 10 of the subject invention further includes an integral fiberglass conduit entry penetration 70 extending through and beyond the bottom wall 28 thereof. The integral conduit entry penetration 70 is disposed adjacent first integral fiberglass coupling 48 remote from the longitudinal axis of the lower trough portion 20 of the dispenser containment system 10. The integral conduit entry penetration 70 is provided such that U.L. listed steel conduit that contains conductive cables (not shown) may extend through dispenser containment system 10 and into the electronics of the dispenser pump 14.

The lower trough portion 20 further includes an integral fiberglass vapor recovery port 72 extending through and beyond the bottom wall 28 thereof. The integral vapor recovery port 72 is disposed adjacent to the integral fiberglass coupling 54 on the longitudinal axis of the lower trough portion 20 of the dispenser containment system 10. The integral vapor recovery port 72 is provided for the removal of Stage II vapor from the dispenser pump 14.

The dispenser containment system 10 of the subject invention further includes first, second and third spaced apart support members 74, 76 and 78, which are disposed orthogonal to the longitudinal axis thereof. Each of the support members 74, 76 and 78 is provided with generally oval bolt holes 80 disposed on the distal ends thereof to enable each to be fastened to opposed brackets 82. The plurality of opposed brackets 82 extend inwardly from beneath the up-turned lip 38 of the hood portion 22. The support members 74, 76 and 78 each include engagement portion 84 having a plurality of bolt holes 86 to enable rigid connection with a shear valve assembly 66.

The dispenser pump containment system 10 of the subject invention may be provided with a leak detection device for detecting the presence of fluid within the containment system 10. The leak detection device may be electrically or mechanically linked to a valve which may shut off the flow of fuel product to the dispenser pump 14 upon detecting fluid in the dispenser containment system 10. Still further the dispenser containment system 10 may be provided with a testing device for enabling the pump operator to detect fluid therein.

Figure 6:
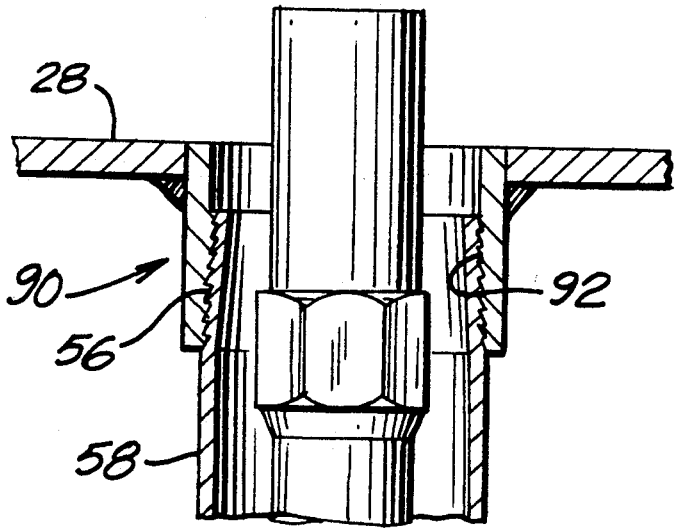
FIG. 6 is a cross-sectional view of an alternate embodiment of the integral coupling of the dispenser containment apparatus of the subject invention.
Figure 2:
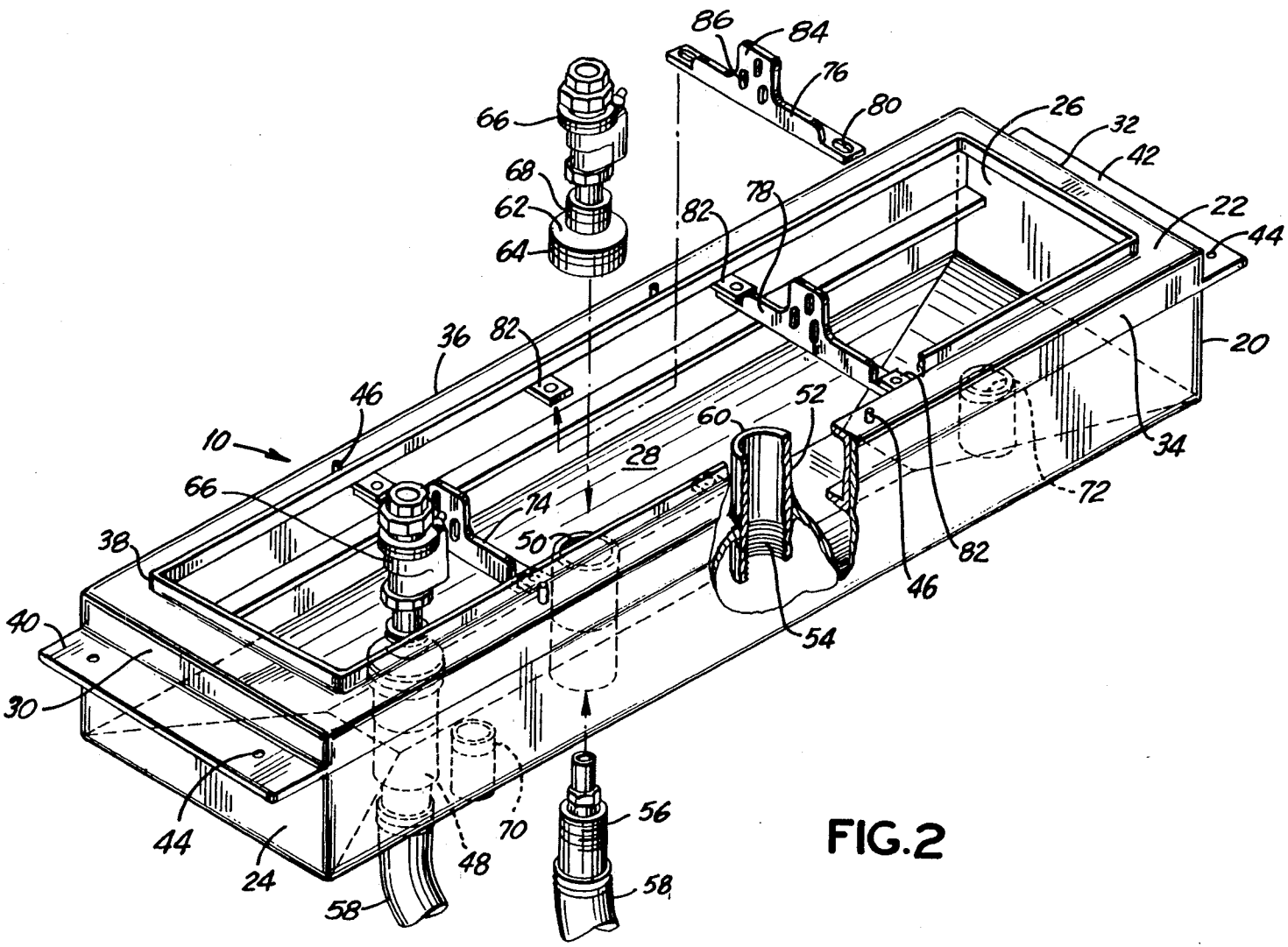
FIG. 2 is an exploded perspective view of the dispenser containment apparatus of the subject invention.
Figure 3:
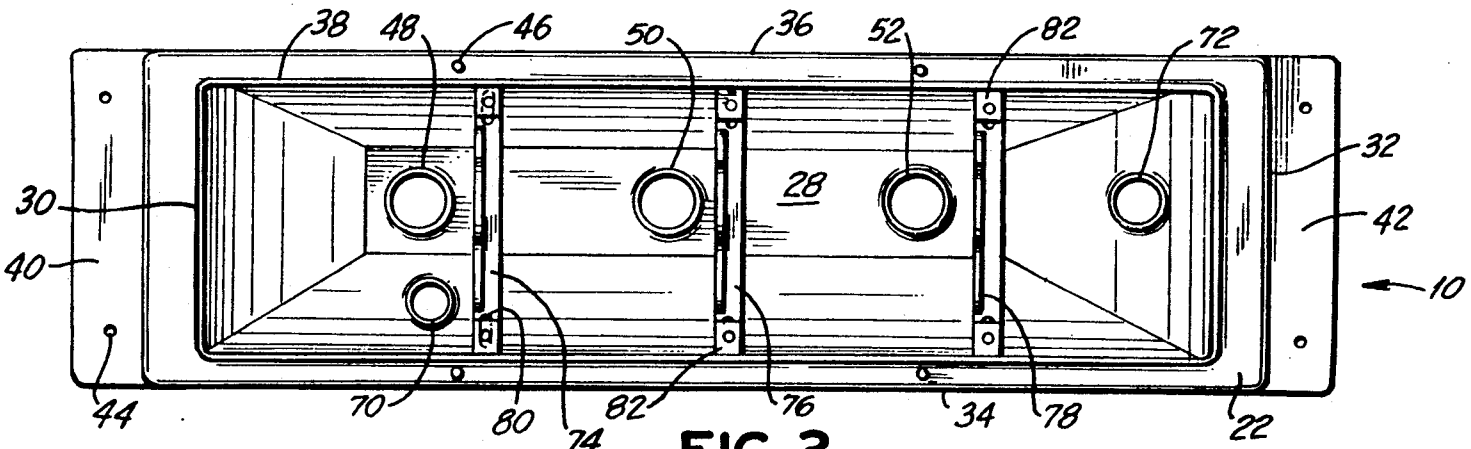
FIG. 3 is a top plan view of the dispenser containment apparatus of the subject invention.
Figure 4:
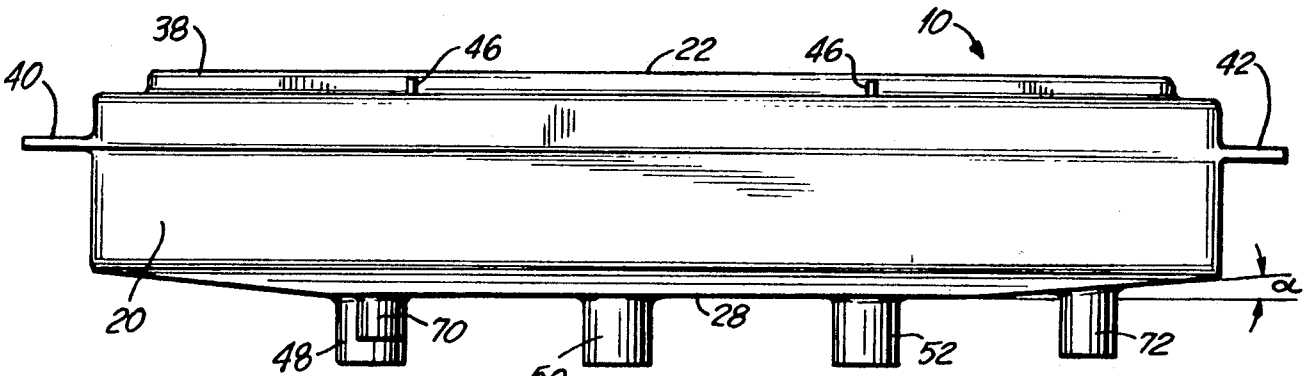
FIG. 4 is a front elevational view of the dispenser containment apparatus of the subject invention.
Figure 5:
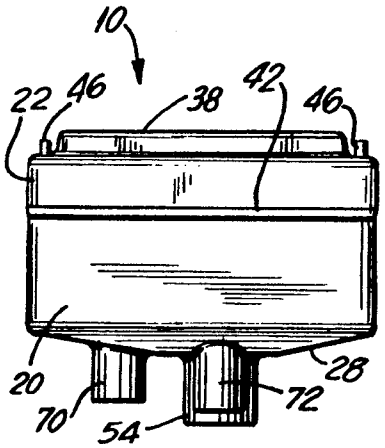
FIG. 5 is a side elevational view of the dispenser containment apparatus of the subject invention.

Referring to FIG. 6, an alternate embodiment of the integral fiberglass coupling of the subject invention is illustrated and is designated generally by reference numeral 90. Integral coupling 90 extends through the bottom wall 28 of the lower trough portion 20 of the dispenser containment system. However, the integral coupling 90, having an internal threaded portion 92, extends below the bottom wall 28 of the lower trough portion 20. In providing the alternate arrangement of the integral coupling 90 any fuel product that leaks from any part of the dispenser system will flow along the tapered bottom wall 28 of the and out of the lower trough portion 20 to return to a containment pump mounted above the subterranean fuel storage tank where a leak detection device is commonly located.

The installation of the dispenser containment system 10 does not require on site drilling involving the use of bulkhead fittings and grommets. Therefore, the installation of the dispenser containment system 10 is not time consuming and it is cost efficient. To install the dispenser containment system 10 of the subject invention, the dispenser containment system 10 is set into the pump island 12 and concrete is poured around it. Thereupon, the outwardly extending flanges 40 and 42 may be bolted to the pump island 12. Shortly thereafter, a threaded product hose 58 may be engaged in the threaded portion 54 of each of the integral fiberglass couplings 48, 50 and 52 and a shear valve assembly 66 may be connected with the upper portion 60 of each of the integral fiberglass couplings 48, 50 and 52 by a rubber bushing 62. At such a time, each of the support members 74, 76 and 78 may be rigidly fastened to a shear valve assembly 66. By this arrangement, a portion of the shear valve assembly 66 may break away from the dispenser pump 14 in reaction to a severe shock which may be caused by a vehicle accidentally colliding with the dispenser pump 14, thereby terminating the flow of fuel to the dispenser pump 14.

The manufacture of the dispenser containment system 10 of the subject invention comprises several steps. The first step in the manufacture of the dispenser containment system 10 involves the procedure in which a mold of the structure 10 is sprayed with fiberglass such that the inner surface of the structure 10 is generally smooth in relation to its outer surface. Thereafter, the second step in the manufacture of the dispenser containment system 10 involves drilling a plurality of prelocated apertures in the bottom wall 28 of the trough portion 20. Subsequently, the third step in the manufacture of dispenser containment system 10 involves extending a fiberglass fitting through each of the apertures such that each fitting extends above and below the bottom wall 28 of the trough portion 20. Thereupon, the fourth step in the manufacture of the dispenser containment system 10 involves wrapping and coating each of the fiberglass fittings and a portion of the bottom wall 28 adjacent to each of the fittings with fiberglass material so as to form the integral structure of the dispenser containment system 10 of the subject invention. Alternatively, the fiberglass fittings may be extended through each of the apertures prior to the step of spraying the structure 10 with fiberglass, thereby eliminating the costly step of wrapping and coating after the initial spray procedure.

Although the invention has been described with respect to a preferred embodiment, it is apparent that modifications can be made without departing from the scope of the invention as defined by the appended claims. For example, the number of integral fiberglass couplings may vary from one to three according to the type of dispenser pump. Further, the invention may include a plurality of integral fiberglass conduit entry penetrations depending upon the type of dispenser pump. Furthermore, the fiberglass conduit entry penetrations may be eliminated and U.L. listed steel conduit nipples may be installed integrally with the bottom surface of the containment system.

We claim:

1. An apparatus for containing leakage from a fuel dispenser pump, said apparatus comprising a substantially unitary rectangular box-like structure formed of fiberglass material, said box-like structure having an upper hood portion and a lower trough portion, said lower trough portion having a bottom wall, a plurality of fiberglass tubular couplings integral with the box-like structure extending through said bottom wall, each of said plurality of fiberglass tubular couplings being provided with an internal threaded portion and being sealingly connected to said fiberglass bottom wall with fiberglass material, thereby forming an integral fiberglass structure which may be quickly and easily installed in a fuel dispenser pump island to contain leakage from a fuel dispenser pump.

2. An apparatus as in claim 1 wherein said bottom wall is downwardly angularly pitched.

3. An apparatus as in claim 1 wherein said plurality of tubular couplings are disposed in spaced apart relationship on the longitudinal axis of the bottom wall of said rectangular box-like structure.

4. An apparatus as in claim 1 wherein said plurality of tubular couplings extend above and below said bottom wall of said box-like structure.

5. An apparatus as in claim 1 wherein said plurality of tubular couplings extend below said bottom wall of said box-like structure.

6. An apparatus as in claim 1 wherein a pair of opposed flanges extend outwardly from said upper hood portion of said box-like structure for quick and easy installation of said apparatus.

7. An apparatus as in claim 1 wherein said upper hood portion of said box-like structure includes a plurality of spaced apart upwardly extending bolts for quick and easy installation of said apparatus.

8. An apparatus as in claim 1 wherein said box-like structure includes at least one tubular member extending through said bottom wall thereof remote from the longitudinal axis thereof for enabling electrical conduit to extend through said bottom wall.

* * * * *